US011540600B2

(12) United States Patent
David

(10) Patent No.: US 11,540,600 B2
(45) Date of Patent: Jan. 3, 2023

(54) LINK BRACELET

(71) Applicant: Montres Breguet S.A., L'Abbaye (CH)

(72) Inventor: Gilles David, Pontarlier (FR)

(73) Assignee: Montres Breguet S.A., L'Abbaye (CH)

( * ) Notice: Subject to any disclaimer, the term of this patent is extended or adjusted under 35 U.S.C. 154(b) by 423 days.

(21) Appl. No.: 16/788,341

(22) Filed: Feb. 12, 2020

(65) Prior Publication Data

US 2020/0297080 A1 Sep. 24, 2020

(30) Foreign Application Priority Data

Mar. 18, 2019 (EP) ..... 19163500

(51) Int. Cl.
*A44C 5/10* (2006.01)
*A44C 5/18* (2006.01)

(52) U.S. Cl.
CPC ..... *A44C 5/107* (2013.01); *A44C 5/18* (2013.01)

(58) Field of Classification Search
CPC ..... A44C 5/107; A44C 5/10; A44C 5/105; A44C 5/02
See application file for complete search history.

(56) References Cited

U.S. PATENT DOCUMENTS

2002/0050133 A1 5/2002 Cazard

FOREIGN PATENT DOCUMENTS

| | | | |
|---|---|---|---|
| CH | 659 571 | A5 | 2/1987 |
| CH | 667 786 | A5 | 11/1988 |
| CH | 694 903 | A5 | 9/2005 |
| CN | 2912319 | Y | 6/2007 |
| CN | 101438871 | A | 5/2009 |
| CN | 104544797 | A | 4/2015 |
| CN | 206964192 | U | 2/2018 |
| CN | 207969775 | U | 10/2018 |
| EP | 1 186 252 | A1 | 3/2002 |
| JP | 2002-199914 | A | 7/2002 |
| JP | 2003-325210 | A | 11/2003 |
| JP | 2006-109952 | A | 4/2006 |
| JP | 3169559 | U | 8/2011 |

(Continued)

OTHER PUBLICATIONS

Combined Chinese Office Action and Search Report dated Dec. 16, 2021 in Patent Application No. 202010189959.X (with English language translation and English translation of Category of Cited Documents), 17 pages.

(Continued)

*Primary Examiner* — Jack W Lavinder
(74) *Attorney, Agent, or Firm* — Oblon, McClelland, Maier & Neustadt, L.L.P.

(57) ABSTRACT

A link bracelet includes two rows of side links forming the edges of the bracelet and at least one row of central links arranged between the side links, wherein the side links each include at least two through holes in the inner face thereof facing the central links and the central links are traversed by at least two housings. The bracelet includes arbors inserted into each of the holes in the side links, the head of the arbors being fitted into the housings of the central links and each having a grooved portion in proximity to the end thereof, and the central links include an opening giving access to the grooved portions, which are arranged to cooperate with a locking member designed to be inserted into the openings in the central links to maintain the assembly of the bracelet.

9 Claims, 4 Drawing Sheets

(56) References Cited

FOREIGN PATENT DOCUMENTS

WO WO 2018/189219 A1 10/2018

OTHER PUBLICATIONS

European Search Report dated Aug. 29, 2019 in European Application 19163500.2 filed Mar. 18, 2019 (with English Translation of Categories of Cited Documents), 8 pages.
Office Action dated Mar. 16, 2021 in corresponding Japanese Patent Application No. 2020-026072 (with English Translation), 5 pages.
Combined Chinese Office Action and Search Report dated Jun. 8, 2022, in corresponding Chinese Patent Application No. 202010189959.X (with English Translation and English Translation of Category of Cited Documents), 15 pages.

LINK BRACELET

CROSS-REFERENCE TO RELATED APPLICATION

This application claims priority to European Patent Application No. 19163500.2 filed on Mar. 18, 2019, the entire disclosure of which is hereby incorporated herein by reference.

FIELD OF THE INVENTION

The invention concerns the field of link bracelets, particularly watch bracelets, made of steel, of precious metal, of metal alloy, of composite material, or of some other material. In such bracelets, the links are held together and hingedly assembled on pins, which can either be press-fitted, screwed in, or freely engaged. The present invention concerns bracelets with links held together and hingedly assembled by means of screws.

BACKGROUND OF THE INVENTION

Such a bracelet is known from FR Patent No. 2688984 which discloses a bracelet with links assembled by means of free pins, whose ends have grooves cooperating with housings of locking members designed to be fixed, in the service position, inside a recess provided in the outer links, which recess opens on the inner side face of these links. These locking members are secured in the outer links by means of screws.

There is also known from EP Patent No. 1186252, a link bracelet which includes two rows of side links and at least one row of central links arranged between the side links, and pins freely arranged in the side and central links but without play. The pins comprise at each end thereof a groove arranged to cooperate with locking members intended to be clipped into recesses formed in the side links in order to maintain the assembly.

Link bracelets of this type have drawbacks relating to the insertion and/or removal of the locking members with respect to the outer links.

Indeed, the insertion and/or removal requires the use of a tool, such as a screwdriver, to assemble and/or disassemble the bracelet or to adjust the bracelet length.

Finally, the reliability of the assembly is not certain in the case of clip-in locking members; the latter may no longer provide sufficient hold over time, or break, or even be partially dislodged in case of shock.

SUMMARY OF THE INVENTION

It is an object of the present invention to overcome all or part of the aforecited drawbacks by providing a bracelet that can easily be disassembled and/or adjusted by the wearer.

It is also an object of the invention, at least in one particular embodiment, to provide a bracelet which is simple and inexpensive to assemble.

To this end, the invention concerns a link bracelet comprising two rows of side links forming the edges of the bracelet and at least one row of central links arranged between the side links, the side links each comprising two holes opening at least onto their inner side face and the central links being at least partially traversed by two housings.

According to the invention, the bracelet comprises arbors inserted into each of the holes in the side links, the arbors being fitted into the housings of the central links and each having a grooved portion or neck portion in proximity to the end thereof, and the central links comprise an opening giving access to the grooved portions, which are arranged to cooperate with a locking member designed to be inserted into the recesses in the central links and to maintain the assembly of the bracelet.

According to other advantageous variants of the invention:

- The locking means include means for blocking the arbors, the blocking means being arranged to cooperate with the grooved portions of the arbors when the latter are housed inside the housings;
- each locking means is held in position in each recess by means of a screw;
- the blocking means are integral with the locking means;
- the housings are accessible through said recess;
- said locking means comprise a cover and two tabs extending vertically from the inner face of said cover, said tabs being arranged to cooperate with the grooved portions of the arbors;
- said cover of the locking member is arranged to rest on a rim formed in the recess;
- the arbors and the corresponding housings have a cylindrical shape that prevents any relative angular movement between the side links and the central links.
- an O-ring seal is arranged between the central link and the locking means.

The invention also concerns a watch equipped with a link bracelet according to the invention.

BRIEF DESCRIPTION OF THE DRAWINGS

Other characteristics and advantages of the invention will appear more clearly upon reading the following description of a specific embodiment of the invention, given simply by way of illustrative and non-limiting example, and the annexed Figures, among which.

DETAILED DESCRIPTION OF PREFERRED EMBODIMENTS

Figure 1:
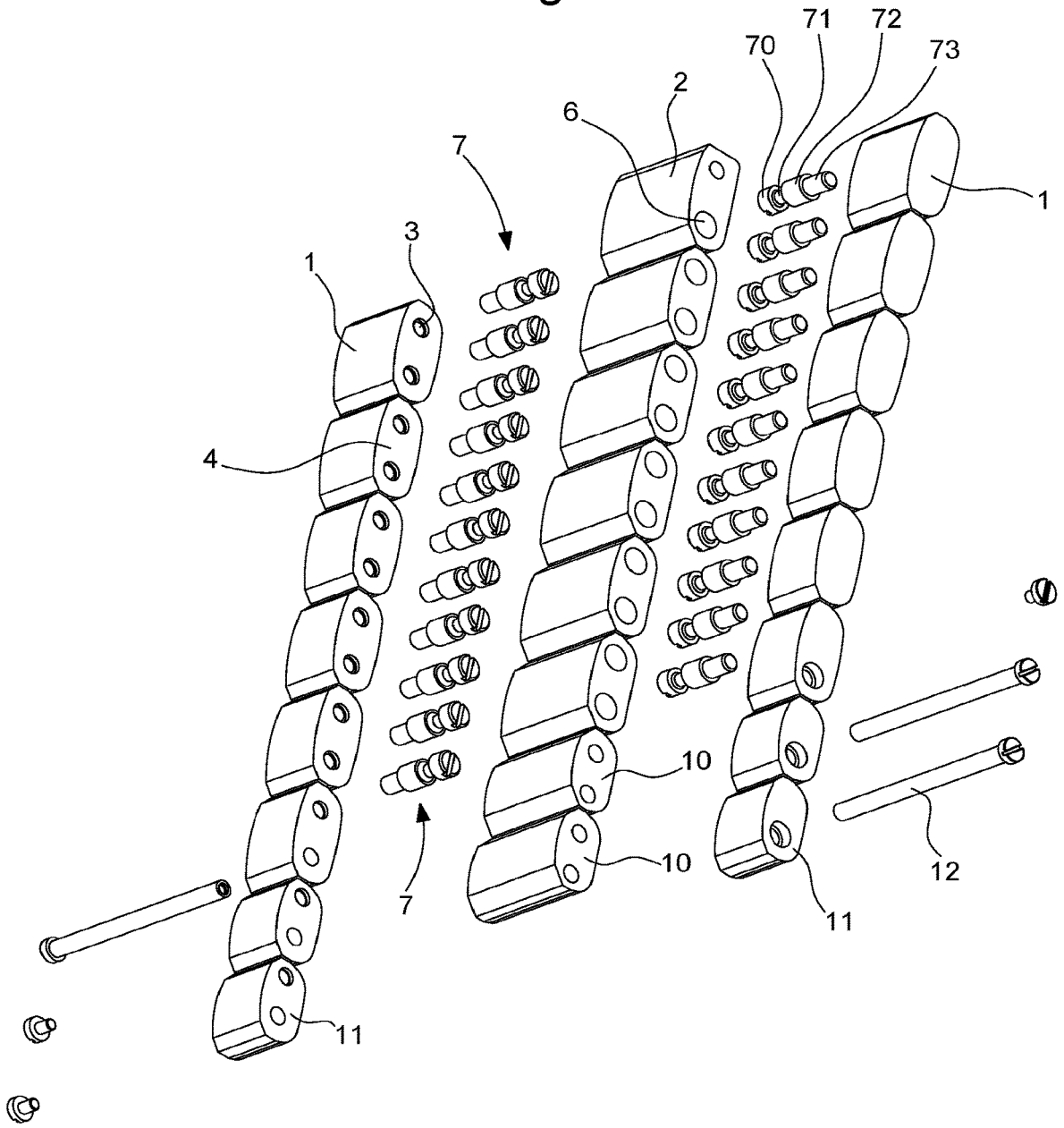
FIG. 1 is an exploded perspective view of a link bracelet according to the invention.

A link bracelet according to the invention will now be described below with reference jointly to FIGS. 1, 2, 3 and 4.

Such a bracelet is generally made of steel, of precious metal or of a metal alloy, and can also be made of a composite material, of ceramic, or even of plastic material.

As illustrated in FIGS. 1 to 4, the bracelet is formed by a set of links 1, 2 arranged in several rows, in the case illustrated the bracelet comprises three rows. Those skilled in the art would have no difficulty in adapting the invention to a bracelet with five rows for example. Bracelet 100 is completed by one or more connecting links 10 assembled on bracelet 100 in a conventional manner by means of arbors 12 through through holes 11 to allow the assembly of a tongue buckle or clasp for example.

Bracelet 100 according to the invention has side links 1 forming the edges of the bracelet and central links 2 placed between the two rows of side links 1.

As can be observed in FIG. 1, side links 1 each have two holes 3 opening onto their inner side faces 4. Holes 3 may be blind or through holes.

Central links 2 are at least partially traversed by two housings 6 which open into a recess 5 formed in the body of each central link 2, recess 5 opening onto the underside of the central link. The 'underside' means the face intended to come into contact with the wrist of the bracelet user; in this manner, the means of assembly of the bracelet is not visible when worn on the wrist. Housings 6 may also be through housings and extend right through the central link.

Side links 1 and central links 2 are hingedly attached to each other by means of arbors 7 arranged in the transverse direction of the bracelet, the arbors being mounted in holes 3 by their end 73. These arbors 7 each have a head 70 and a grooved portion or neck portion 71 at the end thereof, the grooved portion being delimited by head 70 and body 72, which are both larger in diameter than the grooved portion. Grooved portions 71 are accessible from recesses 5 of central links 2 once inserted into housings 6. Arbors 7 can be screwed or press-fitted into holes 3.

The bracelet also includes locking means 8, formed by a cover 80 having the shape and dimensions of recess 5 and two blocking members, or blocking tabs 81, integral with cover 80 and extending vertically from the inner face of the latter. Blocking members 81 move into grooved portions 71 of the arbors and rest against the latter, between body 72 and head 70 of the arbor. Advantageously, recess 5 has an opening provided with a rim 50 arranged to receive cover 80 so that the latter is flush with the surface of central link 2.

Figure 2:
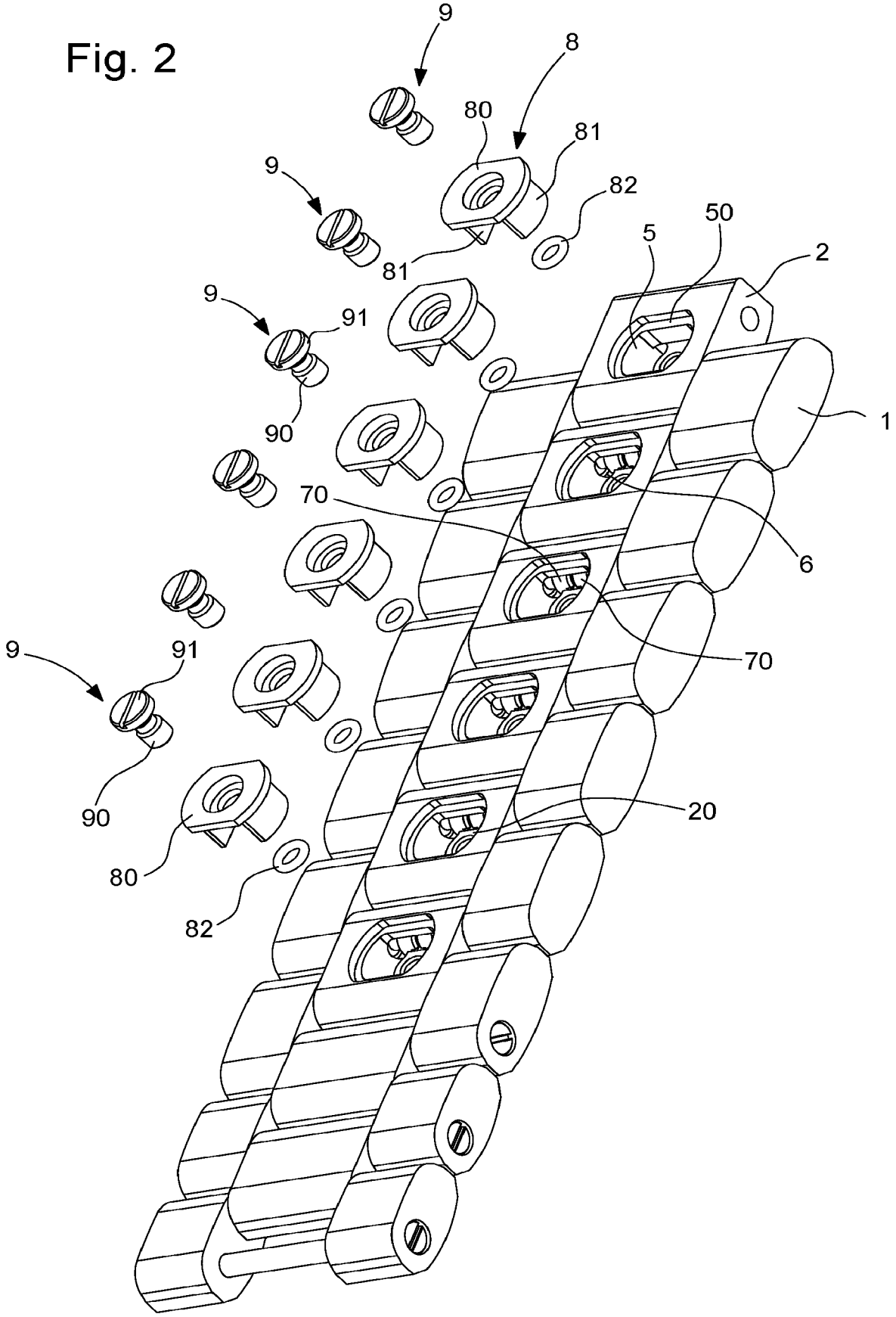
FIG. 2 is a partially exploded view of a link bracelet according to the invention.
Figure 3:
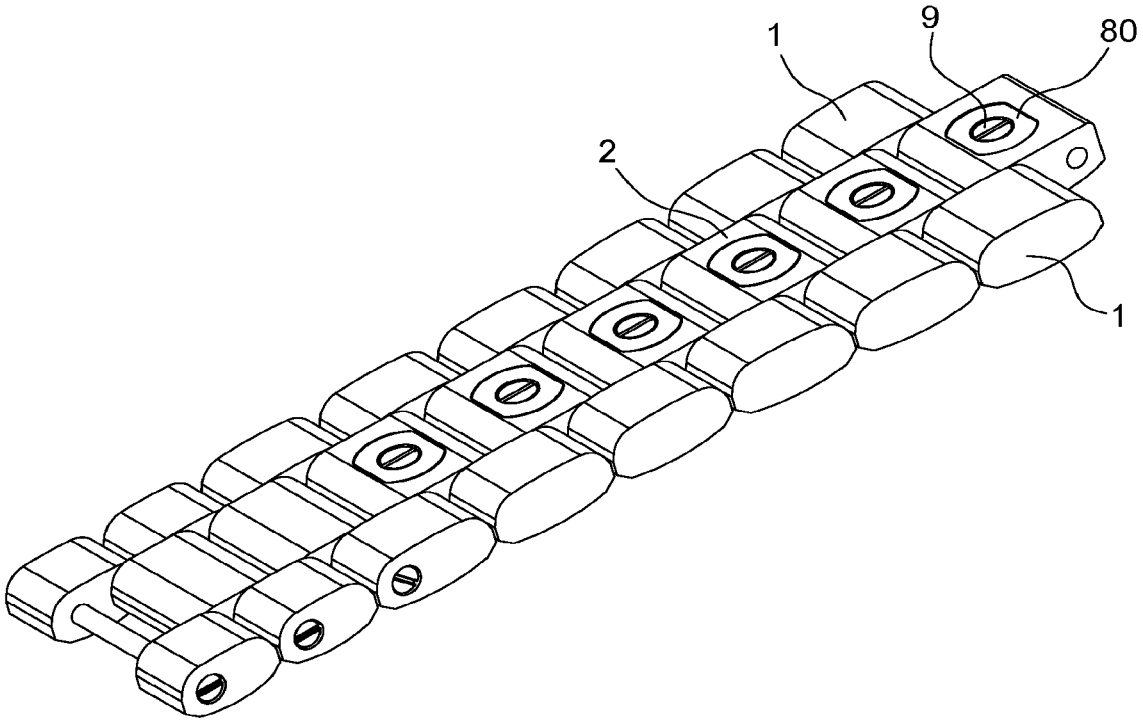
FIG. 3 is an exploded bottom view of a link bracelet according to the invention.

The locking means hold the links together and close recesses 5 once the links are assembled to one another, the user then simply needs to insert a screw 9 through the cover and screw it into central link 2, to hold the locking means in place in recesses 5 of the central links. As seen in FIG. 2, cover 80 has a housing arranged to receive head 91 of screw 9, body 90 of the screw passing through cover 80 via an orifice and being screwed into the bottom 20 of central link 2.

This assembly method makes it possible to axially block arbors 7 and to hold side links 1 and central links 2 via locking means 8 by means of a single part which can easily be inserted and removed by the user.

The positioning of the links is obtained by adjusting arbors 7 in the corresponding holes/housings 3, 6 of links 1, 2 and limits any possible play between the links as a result of relatively simple machining. It is thus possible to make bracelets whose links are hingedly attached to one another with little play.

The link is assembled as set out below. First of all, arbors 7 are inserted into holes 3 in side links 1. Next, side links 1 are placed on central links 2 while inserting the arbor heads 70 into housings 6 of central links 2 until central and side links 2, 1 are positioned against one another. Evidently, to facilitate assembly, the bracelet is assembled with the inner face thereof positioned facing the user.

Once links 1, 2 are placed side-by-side to form a bracelet with at least three rows of links, heads 70 and grooved portions 71 of the arbors are visible and accessible inside recesses 5 of central links 2. Locking means 8 are then placed inside recesses 5 by placing cover 80 facing the opening of recess 5 so that the blocking tabs move into grooved portions 71 of arbors 7.

Figure 4:
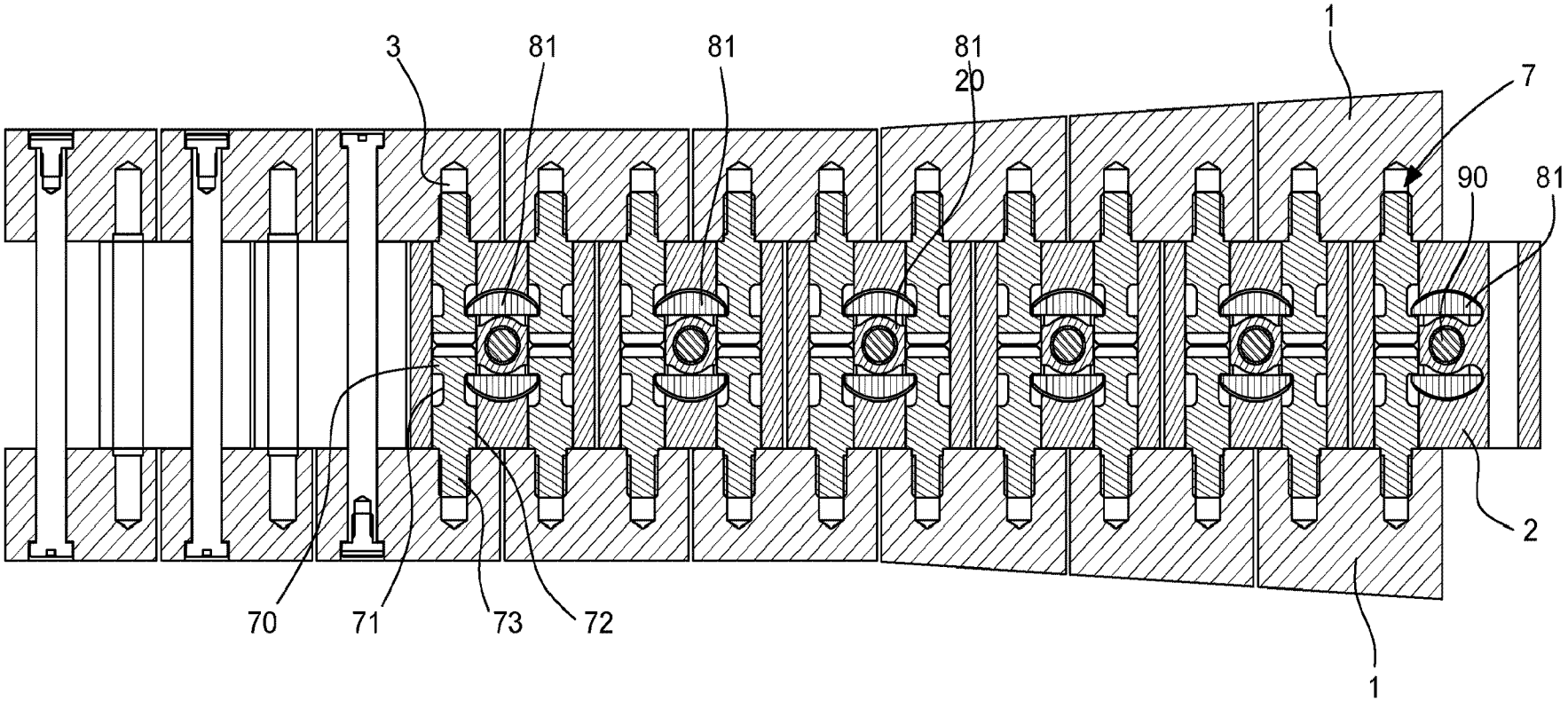
FIG. 4 is a sectional view along the horizontal median plane of a link bracelet according to the invention.

Once locking means 8 are in position, they simply need to be pushed to place cover 80 on rim 50 of recess 5; blocking tabs 81 then securely maintain the assembly of the links, as illustrated in the sectional view of FIG. 4.

Finally, the user simply has to insert screws 9 into each central link 2 and screw them into bottom 20 to secure locking means 8 and finalise the assembly of the bracelet.

Advantageously, an O-ring seal 82 is placed inside recess 5 of central link 2, on bottom 20, in order to remove any play between locking means 8 and the central link. When screw 9 is screwed in, the seal is compressed between bottom 20 and cover 80, which removes any possible play.

This assembly can thus easily be disassembled by the user if he wishes to adjust the bracelet length or replace one of the links. For disassembly, one simply needs to unscrew one or more screws 9, remove one or more locking means 8 and take out the desired link(s).

Such a bracelet makes it possible, in particular, to reduce the number of parts composing the bracelet and above all largely eliminates the press-fit pins of conventional bracelets.

The bracelet is easy to assemble due to the absence of screws and press-fit pins. It can be used for a large number of models and can easily be produced in an automated process. The assembly can be reversed at any time, the bracelet is therefore easy to disassemble, either to adjust its length or to replace a damaged link.

The links can be replaced individually without dismantling the entire bracelet, and length adjustment can easily be carried out by the user.

As a result of these different aspects of the invention, there is provided a link bracelet of simple design offering simple length adjustment and assembly.

Of course, the present invention is not limited to the illustrated example and is capable of various variants and modifications that will appear to those skilled in the art.

NOMENCLATURE

1. Side link
2. Central link
20. Bottom of central link
3. Hole,
4. Inner side faces
5. Recess
50. Rim
6. Housing
7. Arbor
70. Arbor head
71. Grooved portion
72. Arbor body
73. End of the arbor
8. Locking means
80. Cover
81. Blocking tab
82. O-ring seal
9. Screw
90. Screw head
91. Screw body
10. Connecting links
11. Through hole
12. Pin
100. Bracelet

The invention claimed is:

1. A link bracelet comprising:

two rows of side links forming edges of the link bracelet and at least one row of central links arranged between the side links, the side links each comprising two holes opening at least onto an inner side face thereof facing the central links, and the central links being traversed at least partially by at least two throughbores, wherein the link bracelet comprises arbors inserted into each of said holes in the side links, the arbors being fitted into the throughbores in the central links and each having a grooved portion in proximity to an end thereof, and wherein each of the central links comprises a recess giving access to the grooved portion of the arbors located within the central link, which are arranged to cooperate with locking means designed to be inserted into each of the respective recesses in the central links and to maintain an assembly of the link bracelet.

2. The link bracelet according to claim 1, wherein said locking means comprise means for blocking the arbors, said blocking means being arranged to cooperate with the grooved portions of the arbors when the latter are housed inside the throughbores.

3. The link bracelet according to claim 1, wherein each locking means is held in position in each opening with a screw.

4. The link bracelet according to claim 1, wherein the blocking means are integral with the locking means.

5. The link bracelet according to claim 1, wherein the throughbores are accessible through the recess.

6. The link bracelet according to claim 1, wherein said locking means comprise a cover and two blocking tabs extending vertically from an inner face of said cover, said tabs being arranged to cooperate with the grooved portions of the arbors.

7. The link bracelet according to claim 6, wherein said cover of the locking means is arranged to rest on a rim formed in said recess.

8. The link bracelet according to claim 1, wherein the arbors and the corresponding throughbores have a cylindrical shape preventing any relative angular movement between the side links and the central links.

9. The link bracelet according to claim 1, wherein an O-ring seal is arranged between the central link and the locking means.

* * * * *